United States Patent [19]

Pedersen

[11] 4,446,859

[45] May 8, 1984

[54] BREATHING APPARATUS

[75] Inventor: Vernon G. Pedersen, Chicago, Ill.

[73] Assignee: Dacor Corporation, Northfield, Ill.

[21] Appl. No.: 280,371

[22] Filed: Jul. 6, 1981

[51] Int. Cl.[3] ..... B63C 11/16; A62B 7/04

[52] U.S. Cl. ..... 128/204.26; 137/494

[58] Field of Search ..... 128/204.25, 204.26; 137/494, 498, 505.27, 505.29, 484, 508, DIG. 8, DIG. 9

[56] References Cited

U.S. PATENT DOCUMENTS

| | | | |
|---|---|---|---|
| 2,893,386 | 7/1959 | Sajeck | 128/204.26 |
| 4,041,977 | 8/1977 | Matsuno | 128/204.25 |
| 4,140,113 | 2/1979 | Pedersen | 128/204.25 |
| 4,224,938 | 9/1980 | Hilal | 128/204.26 |

FOREIGN PATENT DOCUMENTS

| | | | |
|---|---|---|---|
| 2299210 | 1/1975 | France | 128/204.26 |
| 935911 | 9/1963 | United Kingdom | 137/DIG. 9 |

*Primary Examiner*—Henry J. Recla
*Assistant Examiner*—Karin M. Reichle
*Attorney, Agent, or Firm*—Edmond T. Patnaude

[57] ABSTRACT

A demand regulator for use in underwater breathing employs a longitudinally movable tubular valve member having a transversely opening outlet orifice which is moved relative to the breathing port of the regulator as the valve member is moved axially between the fully opened and fully closed positions.

4 Claims, 4 Drawing Figures

BREATHING APPARATUS

The present invention relates in general to pressure regulation in breathing systems such as the type used, for example, in SCUBA diving, and it relates more particularly to a new and improved means for improving the breathing characteristics of a demand type pressure regulator by automatically varying the venturi action in the regulator as the valve moves between a closed position and a fully open position.

BACKGROUND OF THE INVENTION

Pressure regulators such as those used in underwater breathing apparatus commonly employ the pressure differential between the ambient and a breathing chamber in the regulator to operate an air valve which supplies air to the breathing chamber. This is accomplished by mounting a flexible diaphragm across an opening in the wall of the breathing chamber and using the diaphragm to actuate the air valve. Since the breathing tube is connected to the breathing chamber, the diver breaths from the breathing chamber, and in single hose regulators the diver also exhales through the breathing chamber to the ambient.

When the diver commences to inhale while the air valve is closed, the pressure in the breathing chamber is reduced causing the diaphragm to be sucked into the breathing chamber and thereby to open the air inlet valve. When the user exhales, the pressure in the breathing chamber increases to cause the diaphragm to move out and thereby to close the air inlet valve. In order to reduce the effort required to breath from such regulators it is common practice to design the regulator so that a portion of the inlet air travels as a jet directly into the breathing tube, thereby to provide a so-called venturi effect which educts air from the breathing chamber and prevents the pressure in the breathing chamber from rising above ambient pressure. Consequently, the diaphragm is held in the pulled-in position by the venturi action and holds the air inlet valve open. While such a venturi effect makes it easier for the user to inhale from the regulator, exhaling becomes more difficult inasmuch as the venturi action must be overcome before the air inlet valve can be closed. Accordingly, the amount of venturi action provided must be carefully adjusted for optimum inhalation and exhalation.

In U.S. Pat. No. 4,140,113 there is described a demand regulator having a movable deflector for deflecting an increasingly greater portion of the inlet air away from the breathing tube as the air inlet valve is moved from the fully closed position to the fully opened position. The greatest portion of the inlet air is thus deflected away from the mouthpiece tube when the air inlet valve is fully open and the venturi action would otherwise be at a maximum. In actual practice the air inlet valve does not move to the fully open position during normal operation of a demand regulator. When, however, the air in the supply tank is nearly exhausted and the pressure of the air being supplied to the demand regulator is thus less than normal, i.e., the intermediate pressure is less than 140 p.s.i., the air inlet valve may move to the fully open position in an attempt to meet the inhalation demands of the diver. Under such circumstances the venturi action is relatively low because of the low air velocity wherefor it is unnecessary to deflect any of the inlet air away from the breathing tube to reduce the venturi effect.

In other types of demand regulators stationary deflectors are used to alter the direction of inlet air flow relative to the breathing tube and the breathing chamber within the regulator thereby to provide some venturi action for assisting the diver to inhale through the regulator. Since the venturi action is greatest when the air inlet valve is fully open and air flow is at a maximum, such regulators may have a tendency to free flow, and moreover, exhaling becomes more difficult inasmuch as the venturi action must be overcome before the air inlet valve will close.

SUMMARY OF THE INVENTION

Briefly, there is provided in accordance with the teachings of the present invention a new and improved method and means for automatically adjusting the distribution of air between a breathing tube and the breathing chamber in a demand regulator as the air inlet valve moves between the closed position and the fully open position. In a preferred embodiment of the invention the air inlet valve employs a tubular valve member which is moved in a longitudinal direction toward and away from an associated valve seat, and which has an air inlet orifice in the side for directing the stream of inlet air toward the breathing tube. The inlet orifice thus moves relative to the breathing tube as the air inlet valve opens. Preferably the movable tubular inlet valve is used in combination with a movable or stationary venturi control deflector so as to provide better control of the distribution of the air as the valve is moved between the fully open position and the fully closed position. In this manner a decreasing amount of venturi action is provided as the valve opens from the closed position to the normally open position, but substantially all of the inlet air flows directly into the breathing tube when the valve is fully open as in an emergency.

An added advantage of the tubular inlet valve is the fact that it is unbalanced toward the open position once the valve member has moved away from the seat. Consequently, a lesser amount of venturi action is required to hold the valve open to facilitate inhalation by the user.

GENERAL DESCRIPTION OF THE DRAWING

The present invention will be better understood and additional aspects and advantages thereof will become apparent from a reading of the following detailed description taken in connection with the accompanying drawing wherein.

DETAILED DESCRIPTION OF THE INVENTION

Figure 1:
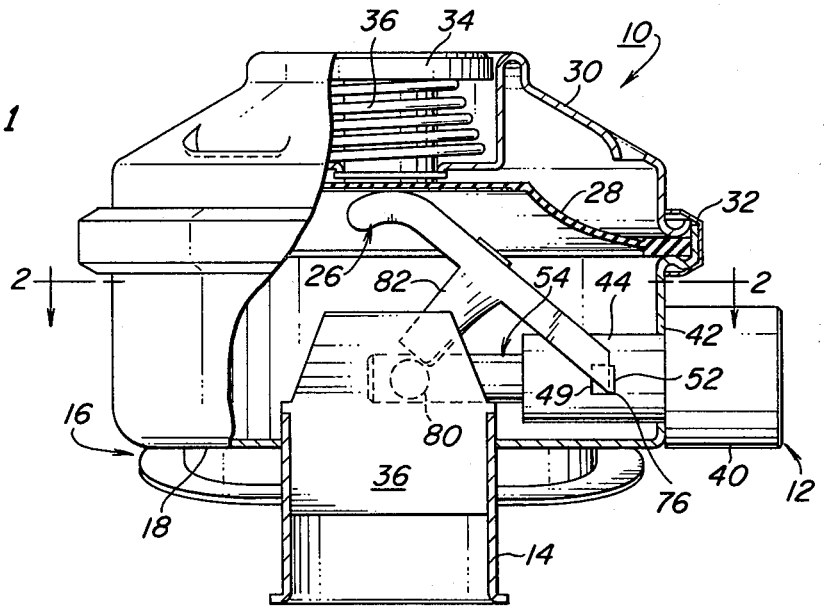
FIG. 1 is a side view, partly in cross-section, of a demand regulator embodying the present invention; the air inlet valve being shown in the fully closed position.
Figure 2:
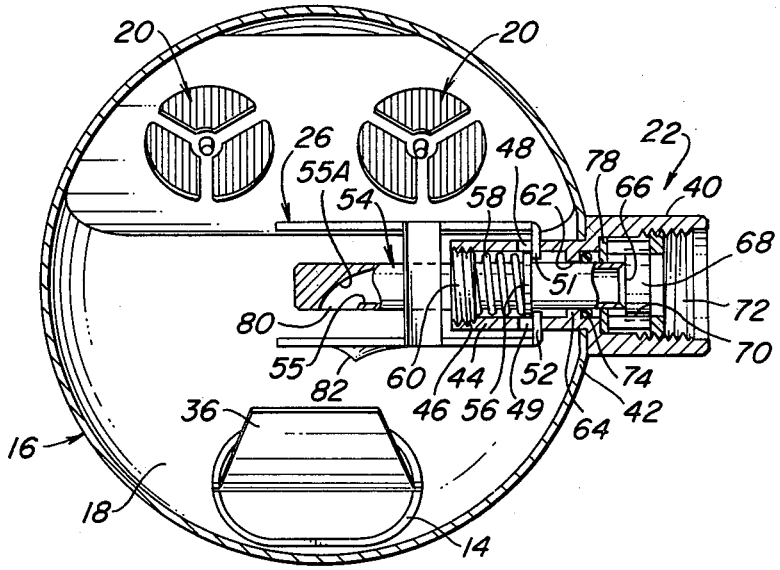
FIG. 2 is a sectional view of the demand regulator shown in FIG. 1 and taken along the line 2—2 thereof.

Referring to FIGS. 1 and 2, there is shown a demand type breathing regulator 10 constituting a preferred embodiment of the invention. The regulator 10 is of the single hose type used in SCUBA diving and it controls the flow of air from a source of pressurized air (not shown) connected to the inlet 12 and a breathing tube 14 through which the diver breaths while under water. Ordinarily a mouthpiece is fitted to the outer end of the tube 14.

The source of air generally comprises a first stage regulator connected to an air tank carried by the diver. The first stage regulator reduces the pressure of air exiting the tank to an intermediate pressure of about 140 p.s.i. which remains substantially constant as the air in the tank is used and the tank pressure drops from about 3000 p.s.i., to 140 p.s.i. Under normal diving conditions the diver will surface before the tank pressure falls below 140 p.s.i. wherefor the air inlet pressure to the regulator 10 is a constant 140 p.s.i. As discussed above, however, there are occasions when the tank pressure falls below 140 p.s.i. wherefor the inlet pressure to the regulator 10 is less than 140 p.s.i.

The regulator 10 may be seen to comprise a cup-shaped housing member 16 having a bottom wall 18 into which the breathing tube 14 opens. It will be understood by those skilled in the art that a soft mouthpiece (not shown) fits over the distal end of the breathing tube 14 for receipt in the mouth of the user to provide a sealed connection between the tube 14 and the diver's mouth. A pair of flapper type check valves 20 are also mounted in the housing member 16 and these valves permit air to be exhausted from the breathing chamber in the regulator to the ambient.

An air inlet valve 22 is mounted in the side wall of the housing member 16 and controls the supply of air from the inlet 12 to the mouthpiece tube 14. As more fully described hereinafter the valve 22 is operated by means of a pivotably mounted actuator lever 26 which is in turn actuated by a flexible diaphragm 28 sealably mounted across the upper open end of the housing member 16. An apertured cover 20 is mounted to the housing member 16 over the diaphragm 28 and is held in place by a suitable clamp ring 32. An emergency manual actuator button 34 is carried by the cover and may be used for manually overriding the diaphragm and opening the air inlet valve 22. A coil spring 37 biases the actuator 34 into the inoperative position as illustrated in FIG. 1.

When the valve 22 is open, air flows from the inlet 12 into the regulator with a portion of the air going directly against a deflector baffle 36 mounted in the tube 14 and extending a short distance into the breathing chamber within the housing 16 between the bottom wall 18 and the diaphragm 28. The baffle 36 redirects the air stream from the inlet orifice into the breathing tube to the mouth of the diver. That portion of the inlet air which does not flow directly into the breathing tube enters the breathing chamber and increases the pressure therein. The airstream flowing directly into the breathing tube produces a venturi action which educts air from the breathing chamber to maintain the pressure therein below the ambient and thereby to assist the diver in holding the air inlet valve open during inhalation.

In my earlier U.S. Pat. No. 4,140,113 there is disclosed the use of a movable deflector baffle which moves across the inlet opening as the inlet valve moves toward the fully open position. Since the venturi effect is proportional both to air velocity and air volume, and the volume increases as the inlet valve moves toward the fully open position under normal operating conditions, the baffle functions to decrease the portion of the inlet air flowing directly into the breathing tube as the air inlet valve member moves from the fully closed position to the fully open position.

In accordance with a feature of the present invention, the airstream flowing directly into the breathing tube when the air inlet valve member is in a less-than fully open, yet substantially open, position is minimized by a deflector baffle, but as the inlet valve opens further the airstream flowing directly into the mouthpiece is again increased. Consequently, when the air supplied to the regulator is at the normal intermediate pressure value of, for example 140 p.s.i., and the inlet valve is in the open position for normal inhalation, the ratio of air directly entering the breathing tube to air directly entering the breathing chamber is at a minimum. When, however, the air pressure to the regulator is less than normal, as for example when the air supply is nearly exhausted, the pressure in the breathing chamber is not appreciably greater than ambient pressure and the inlet valve member is moved beyond its normally open position to its absolutely fully open position. When the inlet valve member is in this latter position the entire inlet air stream flows directly into the breathing tube to provide a maximum venturi effect.

Referring to FIGS. 1 and 2, it may be seen that the air inlet valve 22 comprises a generally tubular housing 40 which extends through an opening in the side wall 42 of the regulator housing and is sealably fixed thereto as by means of a brazing operation. The valve housing 40 further includes a tubular sleeve portion 44 provided with an internally threaded portion 46 at its distal end. A pair of rectangular openings 48 and 49 are respectively provided in opposite sides of the sleeve portion 44 to receive the inner ends of a pair of rectangular arms 51 and 52 of the valve actuator 26. A tubular valve element 54 having an axial passageway 55 therein has an external annular flange 56 which is spring biased against the arms 51 and 52 by a coil spring 58 held in compression between the flange 56 and a retainer screw 60 threaded into the end of the sleeve portion 44 of the valve housing. The retainer screw 60 may be used to adjust the closing force exerted by the spring 58 on the valve element 54. The valve member 54 slidably extends through a circular opening 62 defined by an internal annular flange 64 in the housing 40, and its open end 66 is in sealing engagement with a resilient valve seat 68 mounted at a fixed position within the housing 40. Preferably the wall of the valve member 54 is cut at a sharp angle at the end 66 so as to assure a good seal with the valve seat 68. The valve seat 68 is formed of an elastomeric material and the force of the spring 58 partially embeds the sharp end 66 of the valve member 54 into the surface thereof. As shown, the seat 68 is mounted in a cylindrical recess 70 in a spider 72 which is threaded into the inlet end of the housing 40. An elastomeric 0-ring 74 is captured between the flange 64 and a washer 78 and provides a hermetic seal between the valve member 54 and the housing 40.

In FIGS. 1 and 2 the valve member 54 is shown in a closed position seated against the seat 68 wherefor air supplied to the inlet 12 does not enter the passageway 55 through the valve member. When, however, the pressure in the breathing chamber is reduced below ambient the diaphragm 28 moves into the breathing chamber and causes the actuator 26 to pivot in a counterclockwise direction, as shown in FIG. 1, about the lower outer corners 76 of the openings 48 and 49. The actuator arms 51 and 52 thus press against the flange 56 to move the valve member 54 in an axial direction away from the seat 68 whereby the inlet air flows into the passageway 55 through the open end 66 thereof. The actuator assembly is similar to that described in U.S. Pat. No. 3,633,611.

The passageway 55 extends through the valve member 54 and opens in a lateral direction at an outlet orifice 80 which faces toward the breathing tube deflector baffle 36. As best shown in FIG. 2, the walls of the passageway 55 provide a smooth transition between the axial portion and the transverse portion thereby to ensure a laminar flow of air through the valve member. When the air inlet valve is open the air striking the curved end wall portion 55*a* of the passageway 55 exerts a force on the valve member 54 opposing the force of the spring 58 thereby assisting the diver in holding the valve open during inhalation.

Figure 3:
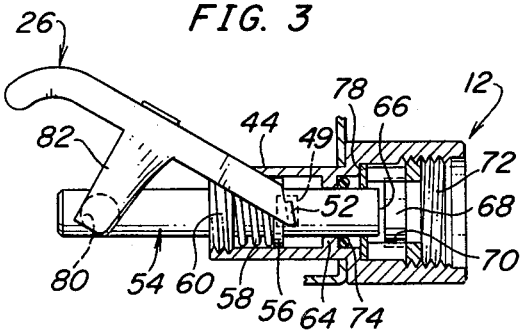
FIG. 3 is a partial view, similar to that of FIG. 1, showing the air inlet valve in an intermediate position.
Figure 4:
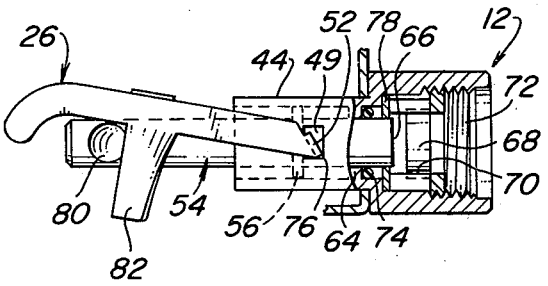
FIG. 4 is also a partial view, similar to that of FIG. 3, but showing the air inlet valve in a fully open position.

In order to reduce the venturi action as the valve member 54 moves from the closed position toward the normally open position, a baffle-like deflector 82 depends from the actuator 26 for movement between the air outlet orifice 80 and the breathing tube deflector 36. In the regulator disclosed in my U.S. Pat. No. 4,140,113 the air outlet orifice is in a fixed position wherefor changes in the venturi action are caused solely by the movable deflector. In the regulator of the present invention, however, the outlet orifice is carried by the valve member and it also changes the venturi action as the valve member moves between the opened and closed positions. As may be seen from an inspection of FIG. 3, the deflector 82 is in front of the orifice 80 and thereby deflects a substantial portion of the inlet airstream into the breathing chamber when the valve member is in the normal open position. When the valve member moves beyond the normally open position into the fully open position shown in FIG. 4, a lesser portion of the inlet airstream is directed against the deflector 82 and thus is deflected into the breathing chamber, thereby increasing the venturi action and making it easier for the diver to breath.

It will be apparent to those skilled in the art that the deflector 82 can be shaped to provide this same effect with a stationary air outlet orifice. However, the provision of the outlet orifice in the tubular valve member itself provides added advantages such as better control of the distribution of the air exiting the air outlet, less obstruction of the air flowing through the inlet valve into the breathing chamber and breathing tube, and use of the inlet air pressure to urge the valve member toward the open position.

The use of a tubular valve member having the outlet in the side can also be used in combination with a stationary, venturi control deflector positoned between the breathing tube deflector and the inlet orifice in the side of the valve member so as to intercept a maximum portion of the inlet air when the need for the venturi effect is at a minimum. In this embodiment of the invention the stationary deflector is located opposite the air outlet orifice only when the valve member is in the normal open position. Therefore when the air inlet valve first opens, the airstream flowing from the orifice goes directly to the breathing tube via the breathing tube baffle 36 and is not obstructed by the stationary, venturi control deflector. Similarly, when the air supply is low and the valve member moves beyond the normal open position to the fully open position, the airstream flowing from the outlet orifice to the breathing tube is unobstructed.

During use of the regulator the friction between the spring 58 and the flange 56 prevents the valve member 54 from rotating. However, with the diaphragm removed the valve member 54 can be rotated by means of a tool for adjusting the angular position of the outlet air orifice. Rotational adjustment of the valve member may thus be used to set the angle of the inlet airstream relative to the breathing tube deflector baffle 36 and/or the venturi control deflector whether it be movable or stationary. In this manner the venturi action can be precisely adjusted.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. In a pressure regulator for breathing apparatus, comprising in combination a regulator housing having a recess therein, a diaphram mounted across said recess to define a chamber in said housing, a breathing tube opening into said chamber, an air inlet valve mounted to said housing and having an air inlet port for connection to a source of compressed air, said air inlet valve including:

a tubular valve housing, a valve seat disposed in said housing in communication with said air inlet port, said air inlet port including a passageway around said valve seat;

a valve member having a tubular side wall with one end open and one end closed and being slidably disposed in said valve housing with the open end positioned for movement toward and away from said valve seat, and spring means operatively positioned between said valve member and said valve housing for biasing said open end of said valve member into sealing engagement with said valve seat to prevent the flow of air into said valve member, and actuator means connected between said diaphram and said valve member for moving said valve member away from said valve seat in response to the pressure differential across said diaphragm between a closed position in sealing engagement with said valve seat and a fully open position spaced a substantial distance from said seat whereby gas passes from said air inlet passageway into said tubular valve member, the closed end of said valve member extending into said chamber from said valve housing and having an air outlet orifice in a portion of the tubular side wall of said valve member located exteriorly of said valve housing, whereby air is directly emitted from said orifice into said chamber, said air inlet valve being positioned in said regulator housing such that air emitted from said orifice is at least partially directed across said chamber into said breathing tube, and deflector means attached to said actuator means for movement in response to movement of said actuator and thereby, with respect to said valve member, from a first position in which said air inlet valve is normally closed to a second position in which said air valve is partially opened and said deflector is between said orifice and said breathing tube wherein a portion of said stream of air is deflected away from said breathing tube and to a third position in which said inlet valve is fully opened and said deflector is positioned such that a lesser portion of said stream of air is deflected away from said breathing tube.

2. The combination set forth in claim 1 comprising elastomeric O-ring means compressed between the exterior of said valve member and said valve housing for providing a hermetic seal between said valve member and said housing.

3. In a pressure regulator for breathing apparatus, comprising in combination a regulator housing having a recess therein, a diaphram mounted across said recess to define a chamber in said housing, a breathing tube opening into said chamber, an air inlet valve mounted to said housing and having an air inlet port for connection to a source of compressed air, said air inlet valve including a valve seat, a valve member having a tubular side wall open at one end and closed at the other end with the open end portion slidably mounted for movement toward and away from said valve seat, and the closed end portion extending into said chamber and spring means urging the open end of said valve member against said valve seat, actuator means connected between said valve member and said diaphragm for moving said valve member in response to the pressure differential across said diaphragm between a close position in sealing engagement with said valve seat and a fully open position spaced from said valve seat, and said valve member closed end portion having an outlet orifice in the side wall thereof for directing a stream of air therefrom, said orifice being positioned so that said stream of air is at least partially directed into said breathing tube, said valve member being rotatable about its longitudinal axis, deflector means attached to said actuator means for movement in response to movement of said actuator means; and said orifice and said deflector means being relatively positioned so that a greater portion of said stream of air bypasses said deflector means when said valve member is in a fully open position than when said valve member is in a partially open position, whereby air flowing through said valve member exerts a force on said valve member urging said valve member away from said valve seat.

4. The combination set forth in claim 3 comprising means for adjusting the compression of said spring.

* * * * *